US008342778B2

(12) United States Patent
Jinnings et al.

(10) Patent No.: US 8,342,778 B2
(45) **Date of Patent: *Jan. 1, 2013**

(54) METHOD AND APPARATUS FOR FACILITATING THE SUBTERRANEAN SUPPORT OF UNDERGROUND CONDUITS HAVING A FIXED INSERTION AXIS

(75) Inventors: John W. Jinnings, Leo, IN (US); Mark Gustin, Harlan, IN (US)

(73) Assignee: Hercules Machinery Corporation, Fort Wayne, IN (US)

( * ) Notice: Subject to any disclaimer, the term of this patent is extended or adjusted under 35 U.S.C. 154(b) by 360 days.

This patent is subject to a terminal disclaimer.

(21) Appl. No.: 12/716,568

(22) Filed: Mar. 3, 2010

(65) Prior Publication Data

US 2010/0263892 A1 Oct. 21, 2010

Related U.S. Application Data

(60) Provisional application No. 61/169,807, filed on Apr. 16, 2009.

(51) Int. Cl.
*E02D 17/18* (2006.01)

(52) U.S. Cl. ..... 405/232; 405/274; 405/276; 173/49; 173/184

(58) Field of Classification Search ..... 405/232, 405/272, 274, 276, 277, 278, 281; 173/49, 173/184, 185

See application file for complete search history.

(56) References Cited

U.S. PATENT DOCUMENTS

| | | | |
|---|---|---|---|
| 1,637,586 | A | 8/1927 | Pates |
| 1,689,378 | A | 10/1928 | Mauterer |
| 2,121,291 | A | 6/1938 | Habe |
| 2,210,788 | A | 8/1940 | Anderson |
| 2,908,140 | A | 10/1959 | Everson, Jr. |
| 4,730,427 | A | 3/1988 | Tomsin |
| 4,917,543 | A | 4/1990 | Cole et al. |
| 5,085,539 | A | 2/1992 | Massarsch |
| 5,154,539 | A | 10/1992 | McCown, Sr. et al. |
| 5,659,985 | A | 8/1997 | Stump |
| 6,140,819 | A | 10/2000 | Peterman et al. |
| 6,273,641 | B1 | 8/2001 | Bull |
| RE37,661 | E | 4/2002 | Raunisto |
| 6,437,726 | B1 | 8/2002 | Price |
| 6,575,663 | B2 | 6/2003 | Kostelnik et al. |
| 6,710,741 | B2 | 3/2004 | Tucker |

(Continued)

FOREIGN PATENT DOCUMENTS

| | | |
|---|---|---|
| FR | 2 789 096 | 8/2000 |

(Continued)

*Primary Examiner* — Frederick L Lagman

(74) *Attorney, Agent, or Firm* — Faegre Baker Daniels LLP

(57) ABSTRACT

A vibratory pile driver configured to insert curved sheet pile beneath a conduit by rotating the pile driver about a fixed pivot element to advance the curved sheet pile along a fixed arc. In one exemplary embodiment, the distance between the fixed pivot element and the clamps that secured the curved sheet pile to the pile driver is the same as the radius of curvature of the curved sheet pile. In another exemplary embodiment, when the curved sheet pile is secured to the pile driver by the clamps, the center of the radius of curvature of the curved sheet pile lies substantially on the rotational axis of the fixed pivot element. In this embodiment, the vibratory pile driver may be rotated about the fixed pivot element to advance the curved sheet pile along an arc having curvature substantially identical to the radius of curvature of the curved sheet pile.

18 Claims, 11 Drawing Sheets

U.S. PATENT DOCUMENTS

| | | | | |
|---|---|---|---|---|
| 6,715,964 | B2 | 4/2004 | Nottingham | |
| 6,735,888 | B2 | 5/2004 | Green et al. | |
| 6,751,553 | B2 | 6/2004 | Young et al. | |
| 6,758,634 | B2 | 7/2004 | Nickelson et al. | |
| 6,851,890 | B2 | 2/2005 | Kostelnik et al. | |
| 6,975,942 | B2 | 12/2005 | Young et al. | |
| 7,062,414 | B2 | 6/2006 | Waite et al. | |
| 7,113,124 | B2 | 9/2006 | Waite | |
| 7,175,369 | B2 | 2/2007 | Fomenkov et al. | |
| 7,400,976 | B2 | 7/2008 | Young et al. | |
| 7,771,140 | B2 * | 8/2010 | Jinnings et al. | 405/184.4 |
| 8,016,518 | B2 * | 9/2011 | Jinnings et al. | 405/184.4 |
| 8,061,934 | B2 | 11/2011 | Jinnings et al. | |
| 8,096,733 | B2 * | 1/2012 | Jinnings et al. | 405/232 |
| 2004/0208708 | A1 | 10/2004 | Nottingham | |
| 2004/0208710 | A1 | 10/2004 | Shreider et al. | |
| 2004/0265068 | A1 | 12/2004 | Guedes De Melo et al. | |
| 2006/0193701 | A1 | 8/2006 | Nottingham | |
| 2009/0057521 | A1 | 3/2009 | Bootsman | |
| 2011/0008111 | A1 | 1/2011 | Jinnings et al. | |

FOREIGN PATENT DOCUMENTS

| | | |
|---|---|---|
| JP | 3-279516 | 12/1991 |
| NL | 8501196 | 11/1986 |
| NL | 9402133 | 7/1996 |

* cited by examiner

METHOD AND APPARATUS FOR FACILITATING THE SUBTERRANEAN SUPPORT OF UNDERGROUND CONDUITS HAVING A FIXED INSERTION AXIS

CROSS REFERENCE TO RELATED APPLICATION

This application claims the benefit under 35 U.S.C. §119 (e) of U.S. Provisional Patent Application Ser. No. 61/169,807, filed Apr. 16, 2009.

BACKGROUND

1. Field of the Invention

The present invention relates to a method and apparatus for subterranean support of underground conduits.

2. Description of the Related Art

Particularly in urban environments, when it is necessary to lay water or sewer pipe, construction crews will often encounter buried electrical, telephone, and/or fiber optic cables. These cables are typically encased in a clay tile or raceway that has a plurality of longitudinal holes through which the cables are pulled. In order to create a unitary subterranean support structure for the cables, individual raceway sections are placed end-to-end and mortared together. In order to lay water or sewer pipes, which must be buried below the freeze line, it is necessary to excavate beneath the raceway and the cables contained therein. However, when excavation occurs beneath the raceway, the raceway must be supported to prevent the raceway from collapsing into the excavated hole.

Currently, in order to support the raceway during and after excavation, the individual raceway tiles are jack hammered, causing the raceway tiles to break apart and expose the cables positioned therein. The exposed cables are then supported by one or more beams extending above the excavated hole. Once the water or sewer pipe is laid, the hole is backfilled and a concrete form is built around the cables. The form is filled with concrete and the concrete is allowed to harden. As a result, the cables are encased within the concrete and are protected from future damage. While this process is effective, it is also time consuming and expensive. Additionally, once the cables are encased in concrete, it is no longer possible to pull new cables through the raceway or to easily extract existing cables from the raceway.

SUMMARY

The present invention relates to a method and apparatus for subterranean support of underground conduits. In one exemplary embodiment, the present invention includes a vibratory pile driver configured to insert curved sheet pile beneath a conduit by rotating the pile driver about a substantially spatially fixed pivot element on the excavator or other machine for positioning the pile driver to advance the curved sheet pile along a fixed arc. In one exemplary embodiment, the distance between the fixed pivot element and the clamps that secure the curved sheet pile to the pile driver is the same as the radius of curvature of the curved sheet pile. When the curved sheet pile is secured to the pile driver by the clamps, the center of the radius of curvature of the curved sheet pile lies substantially on the rotational axis of the fixed pivot element. As a result, the curved sheet pile may be advanced beneath a conduit, such as a raceway, without the need to move or further adjust the position of either the articulated boom of the excavator or the vibratory pile driver during placement of the curved sheet pile. By limiting the movement of the vibratory pile driver to rotation about a fixed pivot element during insertion of the curved sheet pile, the need for the operator of the excavator to simultaneously adjust the elevation and/or alignment of the vibratory pile driver during insertion of the curved sheet pile is eliminated.

In order to provide proper support to the conduit once the excavation is complete, a plurality of sections of curved sheet pile may be used. In one exemplary embodiment, adjacent sections of curved sheet pile are configured to interfit with one another. In one exemplary embodiment, each section of curved sheet pile includes a flange extending from the lower surface of the curved sheet pile. In this embodiment, the flange extends beyond the edge of the curved sheet pile and forms a support surface configured to support an adjacent section of curved sheet pile. The flange has a radius of curvature substantially identical to the radius of curvature of the curved sheet pile. In this manner, with a first section of curved sheet pile positioned beneath a conduit, a second section of curved sheet pile may be advanced beneath the conduit at a position adjacent to the first section of curved sheet pile, such that the lower surface of the second section of curved sheet pile is positioned atop and supported by the support surface of the flange of the first section of curved sheet pile to form a junction between the first and second sections of curved sheet pile. This process can then be repeated until enough sections of curved sheet pile have been positioned beneath the conduit to sufficiently span the excavation site.

By positioning and supporting the lower surface of the second section of curved sheet pile atop the support surface of the first section of curved sheet pile, the flange of the first section of curved sheet pile acts as a seal to prevent the passage of subterranean material between the adjacent sections of curved sheet pile. In addition, the flange of the first section of curved sheet pile provides a guide to facilitate alignment of the second section of curved sheet pile during insertion and also compensates for misalignment of the second section of curved sheet pile relative to the first section of curved sheet pile.

In another exemplary embodiment, each section of curved sheet pile includes a first flange extending from the lower surface of the curved sheet pile and extending beyond a first edge of the curved sheet pile and a second flange extending from the upper surface of the curved sheet pile and extending beyond a second, opposing edge of the curved sheet pile. With this configuration, adjacent sections of curved sheet pile may be interfit with one another. For example, the edge of a first section of curved sheet pile having a flange extending from a lower surface of the first section of curved sheet pile is positioned to extend beneath a second section of curved sheet pile along the edge of the second section of curved sheet pile that has a flange extending from its upper surface. By positioning the first and second sections of curved sheet pile in this manner, the flange of the first section of curved sheet pile will extend beneath and support the second section of curved sheet pile, while the flange extending from the second section of curved sheet pile will extend over the upper surface of the first section of curved sheet pile. In this manner, an interfitting connection is formed between the adjacent sections of curved sheet pile.

Advantageously, by using sections of curved sheet pile with each section having a first flange extending from the lower surface of the curved sheet pile and extending beyond a first edge of the curved sheet pile and a second flange extending from the upper surface of the curved sheet pile and extending beyond a second, opposing edge of the curved sheet pile, the flanges add width to the curved sheet pile that prevents the passage of subterranean material between adjacent sections of the curved sheet pile, facilitate alignment of adjacent sections of curved sheet pile, and prevent the formation of a gap between adjacent sections of curved sheet pile. In addition, the first section of curved sheet pile that is inserted may be gripped and inserted from either of its two opposing sides. Further, these sections of curved sheet pile provide an interconnection and interlocking between adjacent sections of curved sheet pile that facilitates the transfer of loading between adjacent sections of the curved sheet pile. This allows the individual sections of curved sheet pile to cooperate and act as a unitary structure for supporting a conduit. Further, by acting as a unitary structure, the sections of curved sheet pile may be substantially simultaneously lifted without the need to lift each individual section of curved sheet pile independently. The flanges also stiffen the individual sections of curved sheet pile, which makes the individual sections more resistant to bending during insertion.

In another exemplary embodiment, the curved sheet pile may include a generally radially outwardly extending plate secured to the curved sheet pile and extending between opposing edges thereof. The plate is positioned adjacent to the end of the curved sheet pile that is gripped during insertion of the curved sheet pile beneath the conduit. In this manner, the plate acts to push subterranean material that falls onto the curved sheet pile during insertion of the curved sheet pile beneath the conduit back into position beneath the conduit. This prevents the loss of a substantial amount of subterranean material during insertion of the curved sheet pile and helps to facilitate support of the conduit by the curved sheet pile by compacting the subterranean material.

Once a plurality of sections of curved sheet pile have been inserted beneath a conduit and connected to one another, such as with interfitting flanges, the curved sheet pile may be connected to support beams extending across the excavated opening. For example, a pair of beams may be positioned to span the excavated opening with the opposing ends of the beams supported on the ground above the excavated opening. Support rods may be positioned to extend through and/or from the beams and into the excavated opening. In one exemplary embodiment, the support rods include a J-hook configured for receipt within an opening the curved sheet pile. The J-hooks are inserted through the openings in the curved sheet pile in a first orientation and are then rotated ninety degrees to position a portion of the curved sheet pile on the J-hook. By using a plurality of rods, the individual sections of curved sheet pile may be connected to the beam to provide a support structure for the curved sheet pile and, correspondingly, the conduit extending above the curved sheet pile and below the beam.

In one form thereof, the present invention provides a pile driver system, including a pile driver having a clamp and a head portion configured for connection to an articulated boom. The head portion is rotatable relative to the articulated boom about a first pivot element that defines an insertion axis. The clamp has a pair of opposing clamp surfaces that engage the sheet pile. The clamp surfaces need not be moveable relative to each other as long as they firmly engage the trailing edge portion of the sheet pile so as to drive the sheet pile underneath the conduit. For example, one or more wedge-shaped slots that engage the pile could be utilized. In a preferred embodiment, however, the opposing clamp surfaces are moveable relative to each other between an open position and a closed position, the insertion axis being spaced from the opposing clamp surfaces by an insertion distance measured when the opposing clamp surfaces are in a closed position. A section of curved sheet pile having a pile radius of curvature being substantially equal to the insertion distance is secured between the opposing clamp surfaces of the clamp. A point defining a center of the pile radius of curvature lies substantially on the insertion axis. In one form, the pile driver includes a body having an upper portion connected to the head portion, a foot portion and sides extending between the upper and foot portions. The clamp extends laterally outwardly beyond one of the sides.

In another form thereof, the present invention provides a vibratory pile driver system including a vibratory pile driver that includes a head portion having a first pivot element configured to connect the head portion to an articulated boom. The first pivot element defines an insertion axis about which the vibratory pile driver is rotatable. A body is secured to the head portion by a second pivot element, the second pivot element defining a body axis of rotation about which the body is rotatable relative to the head portion. The pile driver includes a vibration generator and a clamp having an upper clamp surface and a lower clamp surface, at least one of said upper clamp surface and said lower clamp surface actuatable relative to the other of said upper clamp surface and said lower clamp surface between an open position configured for receipt of the section of curved sheet pile and a closed position configured to secure a section of curved sheet pile between the upper clamp surface and the lower clamp surface, wherein, with the upper clamp surface and the lower clamp surface in a closed position, the upper clamp surface and the lower clamp surface extend along a plane that is perpendicular to a line extending from the insertion axis to the upper clamp surface and the lower clamp surface.

In yet another form thereof, the present invention provides a pile driver and sheet pile combination, including a pile driver that includes a head portion configured for connection to an articulated boom. The head portion is rotatable relative to the articulated boom about a first pivot element that defines an insertion axis. The pile driver also includes a body that has an upper portion connected to the head portion, a foot portion, and sides that extend between the upper and foot portions. A clamp extends laterally outwardly beyond one of the sides of the body and has a pair of opposing clamp surfaces that are moveable between an open position and a closed position and the insertion axis is spaced from the opposing clamp surfaces by an insertion distance measured when the opposing clamp surfaces are in a closed position. The combination also includes a section of curved sheet pile having a pile radius of curvature that is substantially equal to the insertion distance, wherein, with the section of curved sheet pile secured between the opposing clamp surfaces of the clamp, a point defining a center of the pile radius of curvature lies substantially on the insertion axis.

In yet another form thereof, the present invention provides a method of inserting a section of curved sheet pile beneath a conduit, the method including the steps of providing a section of curved sheet pile having a pile radius of curvature, providing a pile driver having a fixed pivot element and a clamp, the clamp having a pair of opposing clamp surfaces, wherein at least one of the pair of opposing clamp surfaces actuatable to secure the section of curved sheet pile to the pile driver. The section of curved sheet pile is secured to the pile driver with the clamp. The pile driver and curved sheet pile are positioned adjacent subterranean material supporting a conduit. The pile driver is rotated about the fixed pivot element to advance the curved sheet pile beneath the conduit without otherwise altering the position of the pile driver.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention and such exemplifications are not to be construed as limiting the scope of the invention in any manner.

DETAILED DESCRIPTION

Figure 1:
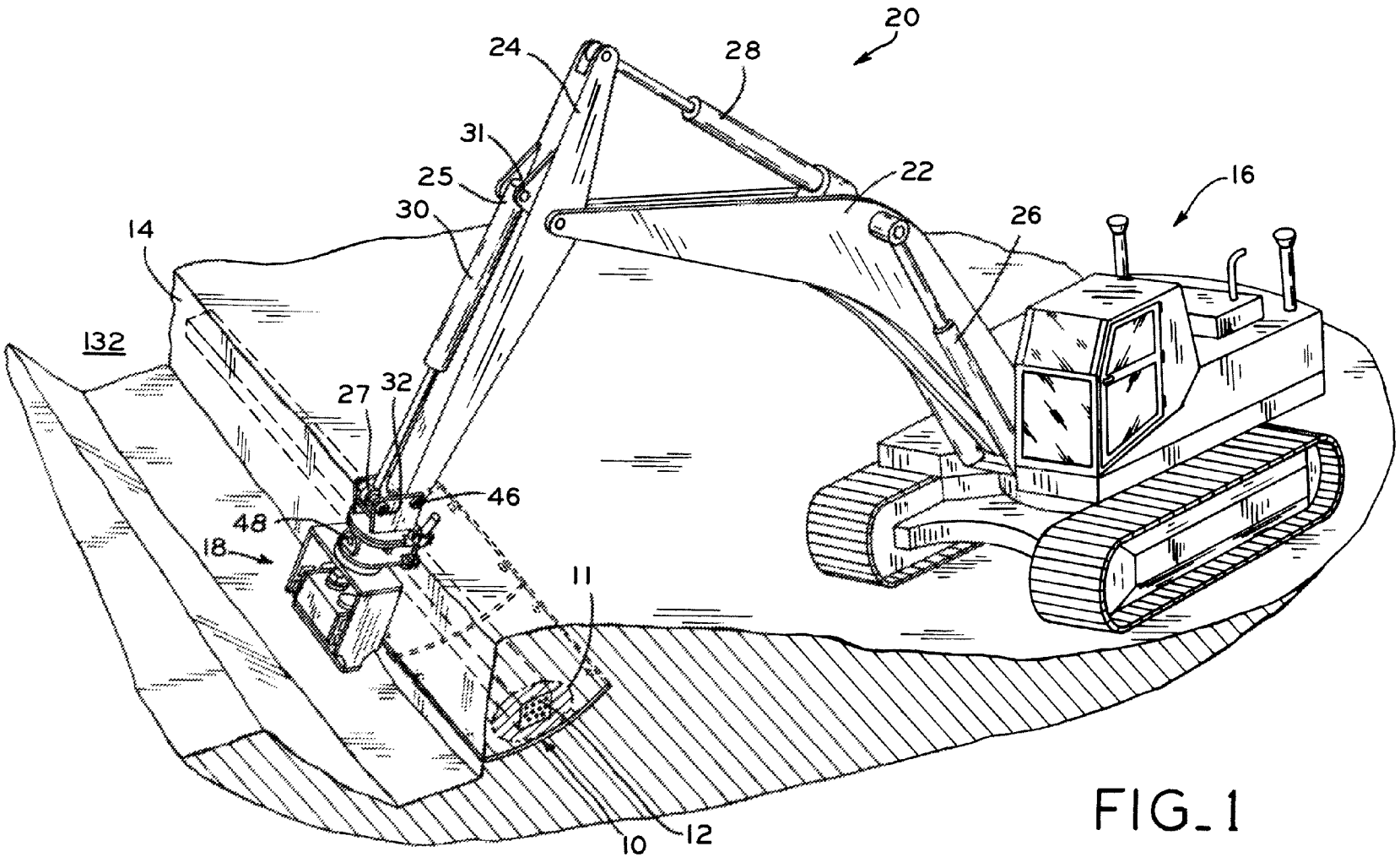
FIG. 1 is a perspective view of an excavator with a vibratory pile driver inserting a section of curved sheet pile beneath a conduit.

Referring to FIG. 1, the installation of a plurality of sections of curved sheet pile 10 beneath conduit 12 is shown. As shown in the figures, conduit 12 is depicted as being a raceway, which has a plurality of openings extending along its longitudinal axis for the receipt of wires, cables, or other types of conduit therethrough. However, while shown herein as a raceway, conduit 12 may be any type of conduit, such as a gas line, an oil line, an individual wire or bundle of wires, a fiber optic line or bundle of fiber optic lines, a sewer line, a gas line, a fuel line, an electric line, an aqueduct, a phone line, and/or any other type of known conduit or a combination thereof. Exclusion zone 11 extends around conduit 12 by a predetermined distance and defines an area that curved sheet piling 10 should not enter during insertion. For example, an electronic control system may be used to facilitate the insertion of curved sheet pile 10 and may be programmed to stop the insertion of curved sheet piling 10 if the control system determines that continued movement of curved sheet piling 10 may result in curved sheet piling 10 entering exclusion zone 11.

As shown in FIG. 1, curved sheet pile 10 is inserted into soil or other subterranean material 14 using excavator 16 and pile driver 18. Excavator 16 includes articulated boom 20 having arms 22, 24 that are actuated by cylinders 26, 28, respectively. Articulated boom 20 also includes hydraulic cylinder 30 connected to arm 24 at first end 25 by pin 31 and connected to pile drive 18 at second end 27 by pin 32.

Figure 2:
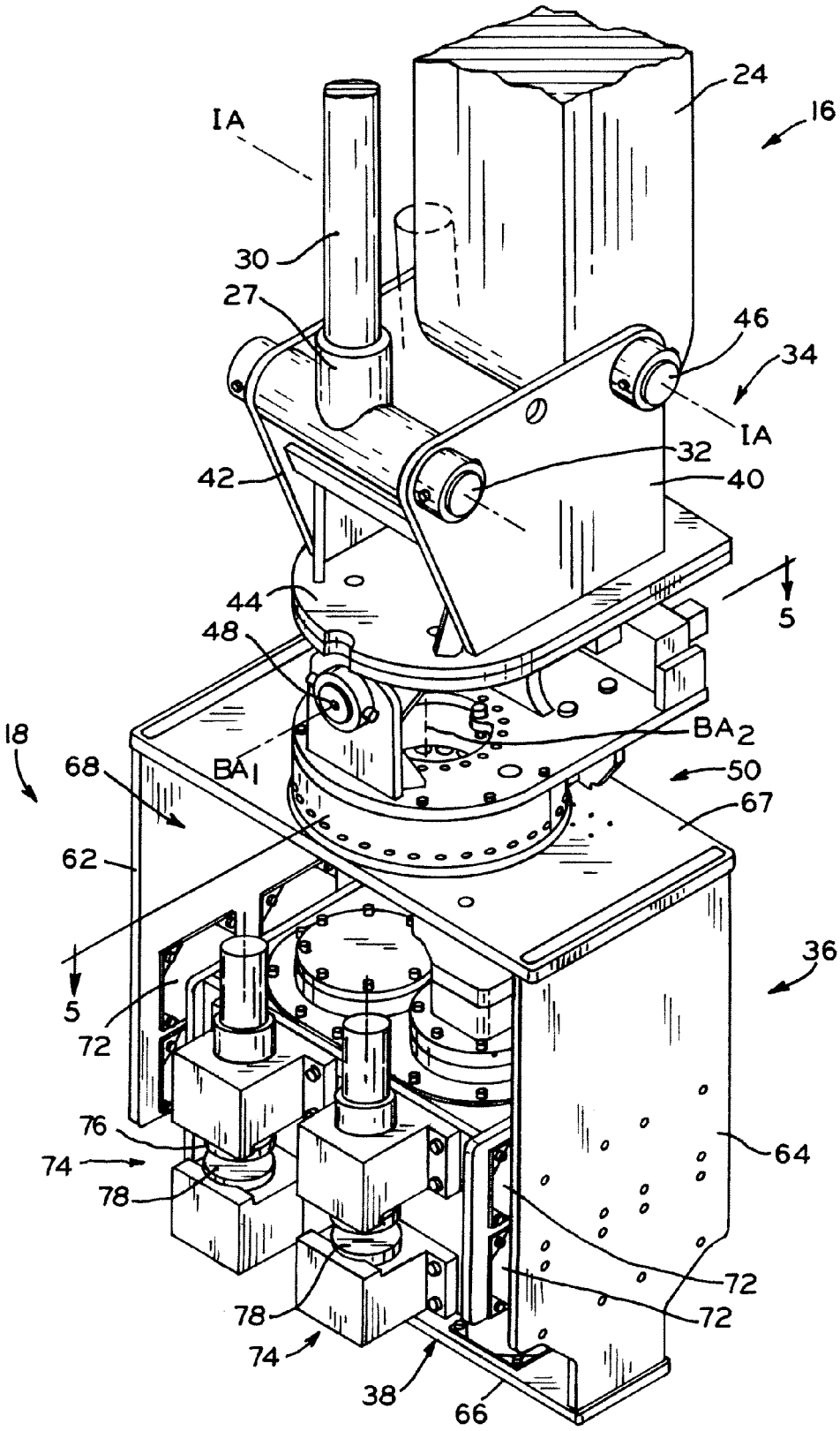
FIG. 2 is a perspective view of the vibratory pile driver and a fragmentary view of the articulated boom of the excavator of FIG. 1.
Figure 3:
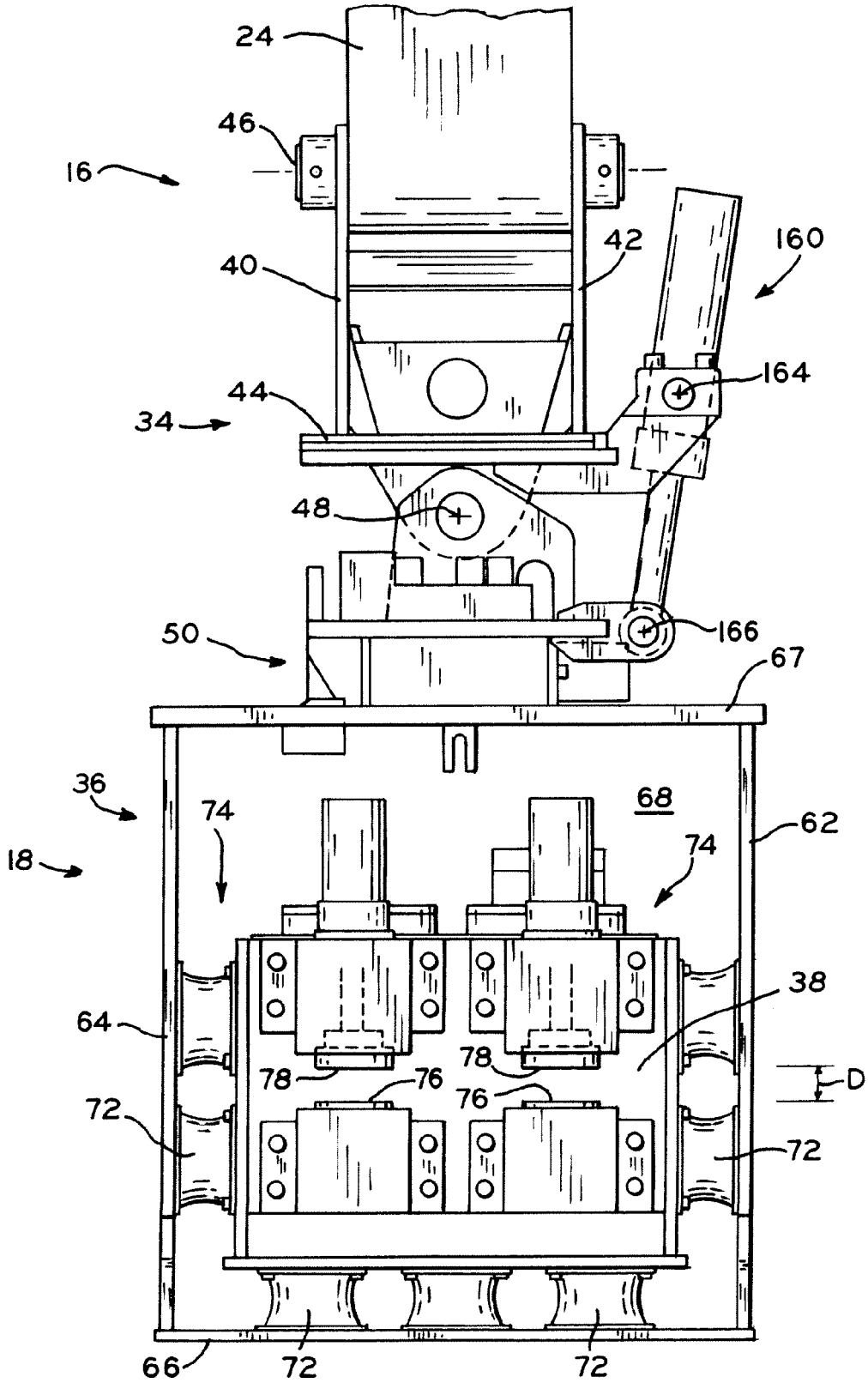
FIG. 3 is a front, elevational view of the vibratory pile driver and articulated boom of FIG. 2 depicting the body of the vibratory pile driver rotated 180 degrees from the position in FIG. 2.
Figure 4:
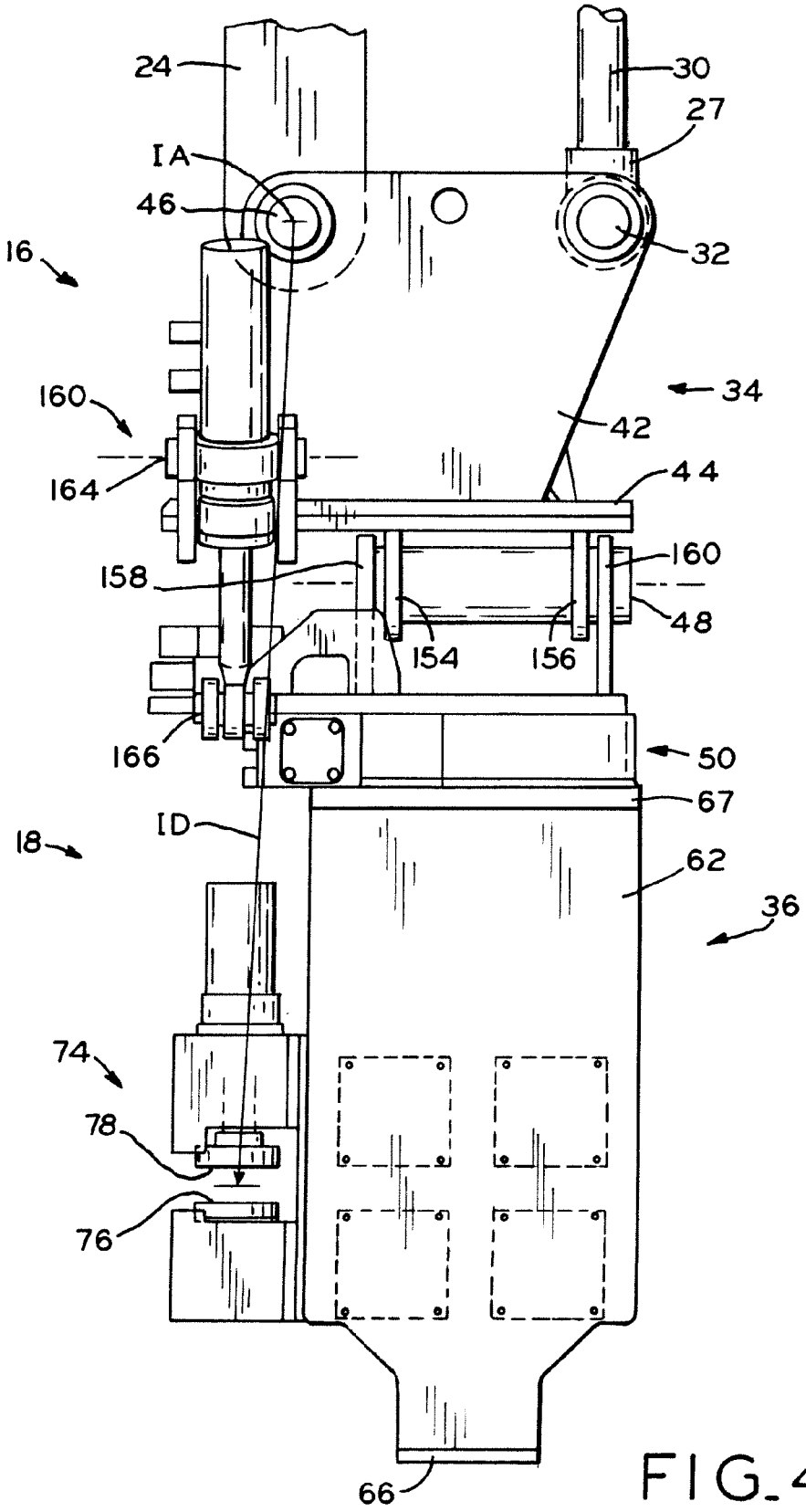
FIG. 4 is a side, elevational view of the vibratory pile driver and articulated boom of FIG. 3.

Referring to FIGS. 2-4, pile driver 18 is shown as a vibratory pile driver. While described and depicted herein as a vibratory pile driver, pile driver 18 may be a non-vibratory pile driver that relies substantially entirely on hydraulic force to advance curved sheet pile 10 into subterranean material 14. In one exemplary embodiment, pile driver 18 relies on the hydraulic force generated by excavator 16 to drive curved sheet pile 10 into subterranean material 14. Referring to FIGS. 2-4, in one exemplary embodiment, pile driver 18 includes head portion 34, body 36, and vibration generator 38. Head portion 34 of pile driver 18 includes support plate 44 having opposing plates 40, 42 that extend upwardly from support plate 44 at a distance spaced apart from one another.

Referring to FIG. 2, plates 40, 42 include two pairs of opposing openings that extend through plates 40, 42 that are configured to receive and support pins 32, 46. As indicated above, pin 32 secures hydraulic cylinder 30 to pile driver 18. Specifically, pin 32 extends through a first opening in plate 40, through an opening formed in second end 27 of cylinder 30, and through an opposing opening in plate 42 to secured cylinder 30 to pile driver 18. A pin or any other known fastener may also be used to secure pin 32 in position and prevent translation of pin 32 relative to plates 40, 42. Similarly, pin 46 is received through a first opening in plate 40, an opening formed in arm 24 of articulated boom 20, and through an opening in plate 42 to secure arm 24 of articulated boom 20 to pile driver 18. A pin or any other known fastener may also be used to secure pin 46 in position and prevent translation of pin 46 relative to plates 40, 42. With pin 46 secured in this position, pin 46 forms a spatially fixed pivot element about which pile driver 18 may be rotated relative to articulated boom 20. Specifically, pin 46, in the form of a first fixed pivot element, defines spatially fixed insertion axis IA about which pile driver 18 may be rotated. By actuating hydraulic cylinder 30, a force is applied to pile driver 18 by cylinder 30 via pin 32, which causes pile driver 18 to rotate about insertion axis IA of the first fixed pivot element formed by pin 46. While pin 46 is described and depicted herein as forming the first fixed pivot element about which pile driver 18 is rotatable, any known mechanism for creating an axis of rotation, such as a worm gear mechanism, may be used to form the first fixed pivot element.

Referring to FIG. 2, body 36 of pile driver 18 is positioned below head portion 34 and is rotatably secured to head portion 34 by pin 48. As shown in FIG. 4, pin 48 extends through openings in plates 154, 156, which extend downwardly from head portion 34, and plates 158, 160, which extend upwardly from body 36. Pin 48 may be secured in position using pins or other known fasteners that limit translation of pin 48 relative to plates 154, 156, 158, 160. As shown in FIG. 2, with pin 48 in this position, pin 48 forms a second fixed pivot element defining first body axis of rotation $BA_1$ about which body 36 of pile drive 18 may be rotated relative to head portion 34. Fist body axis of rotation $BA_1$ extends in a direction substantially orthogonal to insertion axis IA. Specifically, hydraulic cylinder 162 is secured to head portion 34 at pivot 164 and is secured to body 36 by pin 166. Thus, when cylinder 162 is actuated, a force is applied to body 36 by cylinder 162 via pin 166. As a result, body 36 is rotated relative to head portion 34 about $BA_1$ defined by second fixed pivot element formed by pin 48. While pin 48 is described and depicted herein as forming the second fixed pivot element about which body 36 is rotatable relative to head 34, any known mechanism for creating an axis of rotation, such as a worm gear mechanism, may be used to form the first fixed pivot element. In one exemplary embodiment, body 36 is rotatable about first body axis of rotation $BA_1$ through sixty degrees.

Figure 5:
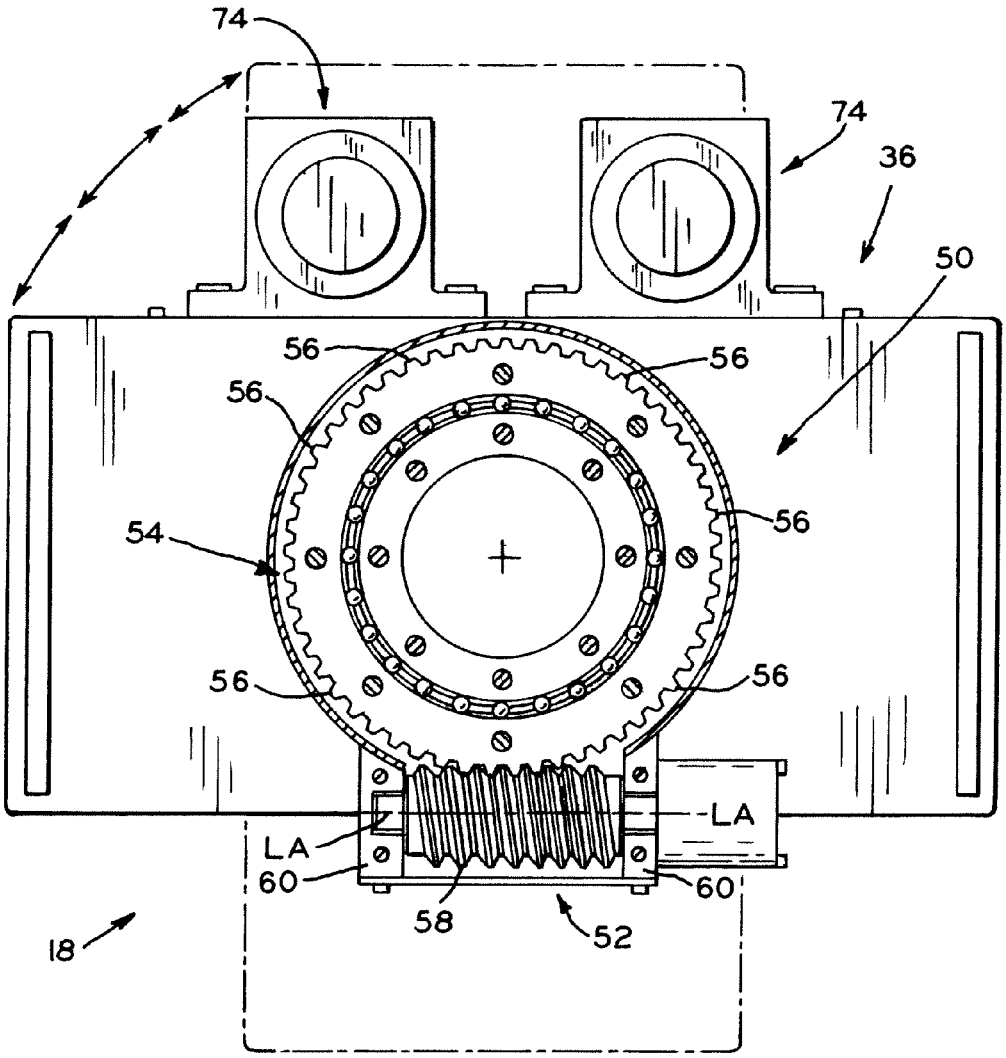
FIG. 5 is a cross-sectional view of the vibratory pile driver of FIG. 2, taken along line 5-5 of FIG. 2.

In addition to rotation about first body axis of rotation $BA_1$, the lower portion of body 36 is rotatable relative to head portion 34 through 360 degrees about second body axis of rotation $BA_2$, shown in FIG. 2. Second body axis of rotation $BA_2$ is substantially orthogonal to both insertion axis IA and first body axis of rotation $BA_1$. Referring to FIG. 5, rotation of the lower portion of body 26 about second body axis of rotation $BA_2$ is achieved by worm gear mechanism 50, which defines a third fixed pivot element. Worm gear mechanism 50 includes worm 52 and worm gear 54. Worm gear 54 includes a plurality of teeth 56 configured to meshingly engage thread 58 extending from worm 52. Worm 52 is translationally fixed by opposing brackets 60, but is free to rotate about longitudinal axis LA. Rotation of worm 52 may be achieved in any known manner, such as by using a hydraulic motor. As worm 52 is driven to rotate about longitudinal axis LA, thread 58 engages teeth 56 and causes corresponding rotation of worm gear 54. As worm gear 54 rotates, the lower portion of body 36 of pile driver 18, which is rotationally fixed thereto, correspondingly rotates. By rotating worm 52, the lower portion of body 36 may be rotated through 360 degrees. In addition, the direction of rotation of the lower portion of body 36 may be reversed by reversing the direction of rotation of worm 52.

Referring again to FIGS. 2-4, the lower portion of body 36 of pile driver 18 includes sides defined by side plates 62, 64, bottom plate 66 forming the foot portion, and top plate 67. Side plates 62, 64 are rigidly fixed to bottom plate 66 and top plate 67, such as by welding, and cooperate with bottom plate 66 and top plate 67 to define opening 68 therebetween. Vibration generator 38 is positioned within an opening 68 and secured to side plates 62, 64 and bottom plate 66. Specifically, vibration generator 38 is secured to side plates 62, 64 and bottom plate 66 via dampers 72. Dampers 72 are connected between plates 62, 64, 66 and vibration generator 38 to limit the transmission of vibration generated by vibration generator 38 through pile driver 18 and, correspondingly, through articulated boom 20 of excavator 16.

Vibration generator 38 operates by utilizing a pair of opposing eccentric weights (not shown) configured to rotate in opposing directions. As the eccentric weights are rotated in opposite directions, vibration is transmitted to clamps 74. Additionally, any vibration that may be generated in the direction of side plates 62, 64 of the lower portion of body 34 may be substantially reduced by synchronizing the rotation of the eccentric weights. While vibration generator 38 is described herein as generating vibration utilizing a pair of eccentric weights, any known mechanism for generating vibration may be utilized. Additionally, as indicated above, vibration generator 38 may be absent from hydraulic pile driver 18, and pile driver 18 may utilize hydraulic power generated by excavator 16 or a separate hydraulic pump (not shown) to advance curved sheet pile into subterranean material 14 without the need for vibration generator 38.

As shown in FIGS. 2-4, clamps 74 are secured to vibration generator 38 such that vibration generated by vibration generator 38 is transferred to clamps 74. Clamps 74 extend laterally outward beyond one of the sides of body 36 and include opposing clamp surfaces 76, 78. Clamp surfaces 76, 78 are separated by distance D, shown in FIG. 3, when the clamps are in the open position of FIG. 3. In one exemplary embodiment, first clamp surface 76 is actuatable to advance first clamp surface 76 in the direction of clamp surface 78. In one exemplary embodiment, clamp surface 76 is formed as a portion of a hydraulic cylinder such that as the hydraulic cylinder is advanced, clamp surface 76 is correspondingly advanced. In another exemplary embodiment, both first clamp surface 76 and second clamp surface 78 are moveable relative to one another.

By advancing clamp surface 76 in the direction of second clamp surface 78, distance D between first and second clamp surfaces 76, 78 is decreased. For example, with clamps 74 in the open position, an edge of curved sheet pile 10 may be advanced through the opening defined between first and second clamp surfaces 76, 78. Then, clamp surface 76 may be advanced in the direction of clamp surface 78. As clamp surface 76 advances toward clamp surface 78, clamp surface 76 will contact curved sheet pile 10. Clamp surface 76 may continue to advance until curved sheet pile 10 is gripped between clamp surfaces 76, 78, such that any movement of pile driver 18 will result in corresponding movement of curved sheet pile 10. Additionally, in one exemplary embodiment, clamp surfaces 76, 78 are substantially planar and extend along a plane that is substantially perpendicular to second body axis of rotation $BA_2$. As used herein with respect to clamp surfaces 76, 78, the phrase "substantially planar" is intended to include surfaces that would form substantially planar surfaces, but for the inclusion of undulations, projections, depressions, knurling, or any other surface feature intended to increase friction between clamps surface 76, 78 and a section of curved sheet pile.

Additionally, clamps 74 are positioned such that, with clamp surfaces 76, 78 in a closed position, i.e., in contact with one another, clamp surfaces 76, 78 are spaced an insertion distance ID from insertion axis IA of pile driver 18, as shown in FIG. 4. Referring to FIG. 4, in one exemplary embodiment, clamp surfaces 76, 78 are actuatable to extend along a plane that is substantially perpendicular to a line extending perpendicularly from insertion axis IA to the center of clamp surfaces 76, 78.

Referring to FIGS. 6-9, an exemplary embodiment of curved sheet pile 10 is shown as curved sheet pile 80. Curved sheet pile 80 has a radius of curvature RA that extends between gripping edge 82 and leading edge 84 of curved sheet pile 80. In exemplary embodiments, radius of curvature RA of curved sheet pile 80 may be as small as 3.0, 4.0, 5.0, and 6.0 feet and may be as large as 7.0, 8.0, 9.0, or 10.0 feet. Side edges 86, 88 of curved sheet pile 80 extend between gripping edge 82 and leading edge 84 and cooperate with gripping edge 82 and leading edge 84 to define a perimeter of curved sheet pile 80. Openings 90 extend through curved sheet pile 80 between upper surface 96 and lower surface 98 of curved sheet pile 80 to provide openings for securement of curved sheet pile 80 to a beam or other support structure positioned above the excavated opening. In one exemplary embodiment, openings 90 are positioned at the corners of curved sheet pile 10 formed between gripping edge 82, leading edge 84, and side edges 86, 88. Additionally, in one exemplary embodiment, openings 90 are positioned substantially adjacent to gripping edge 82 and leading edge 84. As shown in FIGS. 6-9, openings 90 are formed as elongate openings having arcuate ends 92 that connect opposing straight side walls 94.

Figure 6:
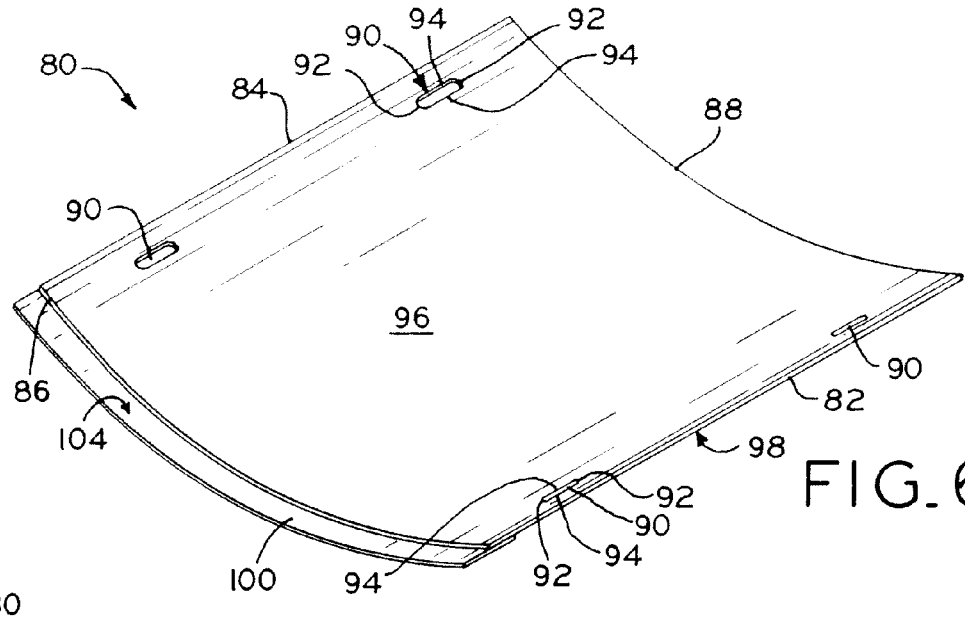
FIG. 6 is a perspective view of a section of curved sheet pile according to an exemplary embodiment.
Figure 7:
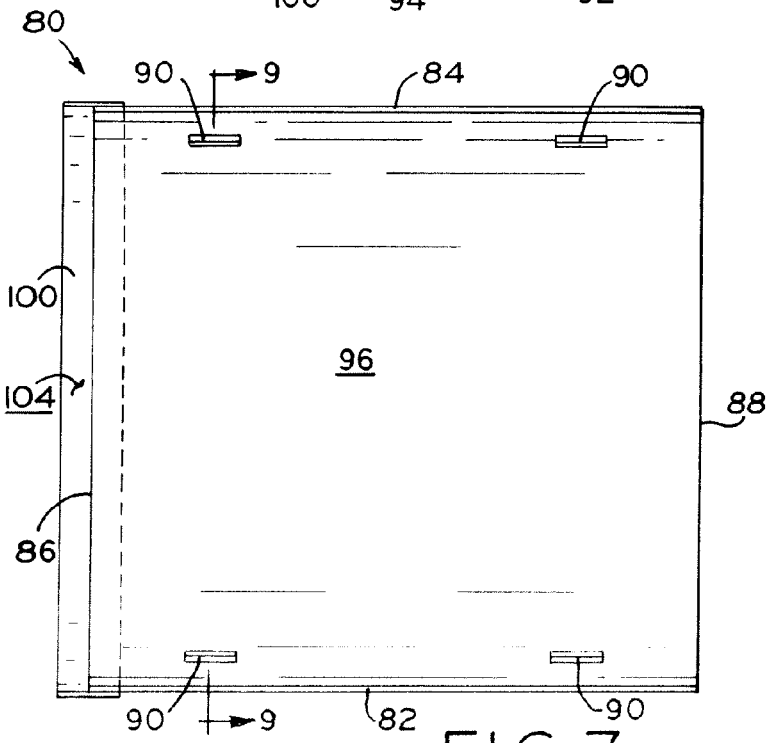
FIG. 7 is a plan view of the curved sheet pile of FIG. 6.
Figure 9:
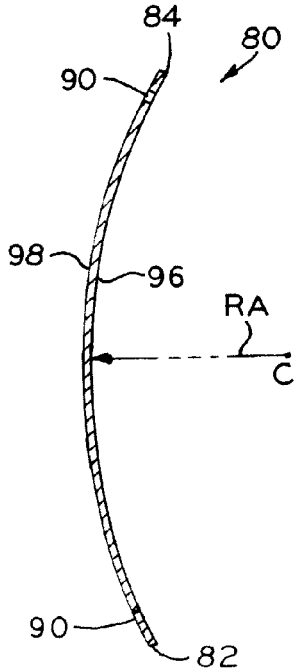
FIG. 9 is a cross-sectional view of the curved sheet pile of FIG. 7 taken along line 9-9 of FIG. 7.
Figure 8:
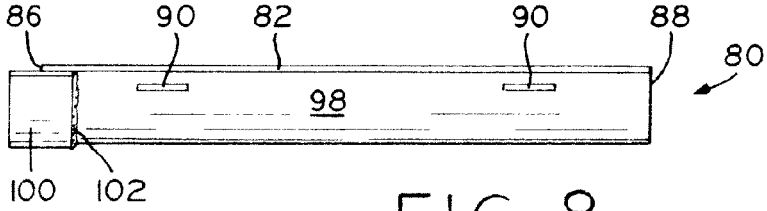
FIG. 8 is a front, elevational view of the curved sheet pile of FIG. 6.
Figure 10:
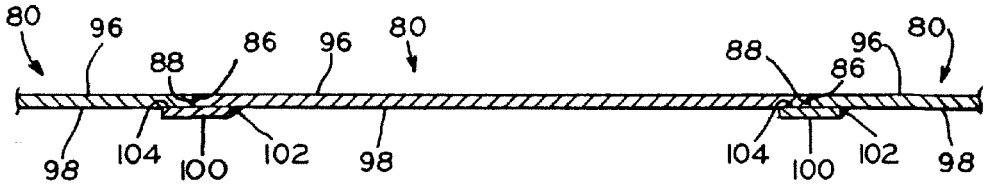
FIG. 10 is a cross-sectional view of a plurality of sections of curved sheet pile according to the embodiment of FIG. 6 positioned adjacent to one another.

Referring to FIGS. 6-8, curved sheet pile 80 also includes flange 100 extending from lower surface 98 thereof. Flange 100 may be secured to lower surface 98 of curved sheet pile 80 in any known manner, such as by welding. For example, flange 100 may be secured to lower surface 98 of curved sheet pile 80 by weld 102. A portion of flange 100 extends from side edge 86 of curved sheet pile 80 and defines support surface 104. As shown in FIG. 10, support surface 104 may be positioned to extend under lower surface 96 of an adjacent section of curved sheet pile 80 to provide for the alignment and support of the adjacent section of curved sheet pile 80. Referring to FIG. 10, when positioned in this manner, opposing side edges 86, 88 of adjacent sections of curved sheet pile 80 contact one another and flange 100 acts to interfit the opposing sections of curved sheet pile 80 together. In one exemplary embodiment, the adjacent section of curved sheet pile 80 that is supported atop support surface 104 of flange 100 may be welded to flange 100 or otherwise secured thereto to form a firm connection between adjacent sections of curved sheet pile 80.

Figure 11:
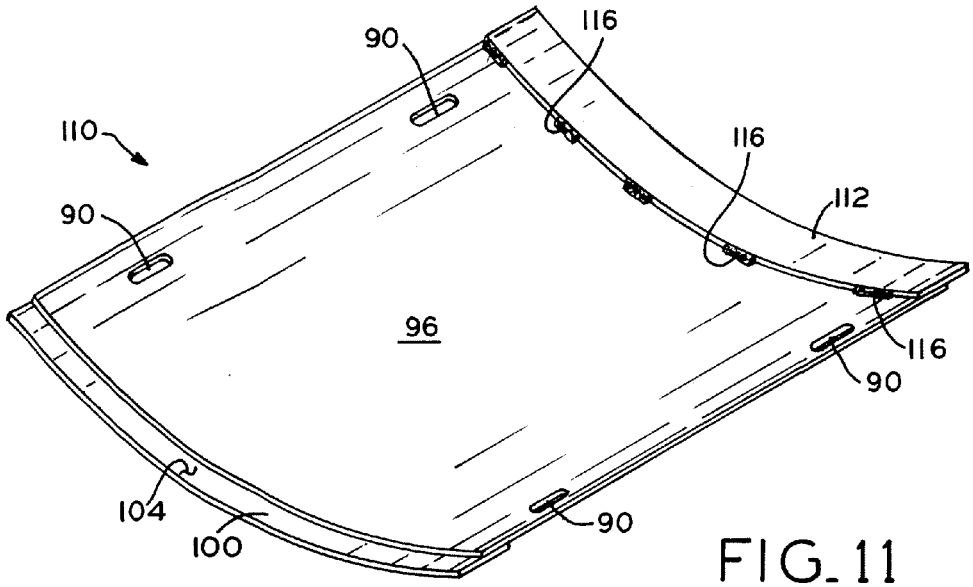
FIG. 11 is a perspective view of a section of curved sheet pile according to another exemplary embodiment.
Figure 12:
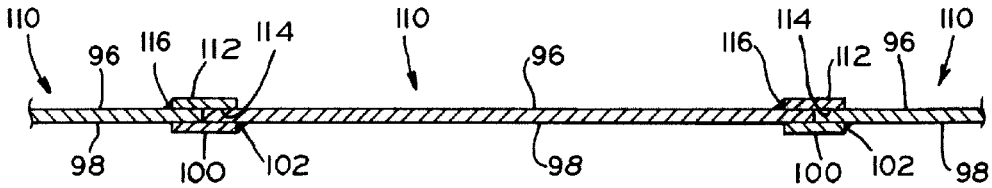
FIG. 12 is a cross-sectional view of a plurality of sections of curved sheet pile according to the embodiment of FIG. 11 positioned adjacent to one another.

Referring to FIGS. 11 and 12, another exemplary embodiment of curved sheet pile 10 is shown as curved sheet pile 110. Curved sheet pile 110 is substantially similar to curved sheet pile 80 and like reference numerals have been used to identify identical or substantially identical parts therebetween. Referring to FIG. 11, in addition to flange 100 extending from lower surface 98 of curved sheet pile 110, curved sheet pile 110 also includes flange 112 extending from upper surface 96 of curved sheet pile 110. Flange 112 extends beyond side edge 86 of curved sheet pile 110 to define support surface 114. Flange 112 may be secured to curved sheet pile 110 in any known manner, such as by welding. Specifically, flange 112 may be secured to curved sheet pile 110 at welds 116.

Referring to FIG. 12, sections of curved sheet pile 110 are shown positioned adjacent to and interfit with one another. Flanges 100, 112 of curved sheet pile 110 cooperate with upper and lower surfaces 96, 98 of the adjacent sections of curved sheet pile, respectively, to interfit adjacent sheets of curved sheet pile to one another. Specifically, referring to FIG. 12, flange 100 of curved sheet pile 110 extends beneath lower surface 98 of an adjacent sheet of curved sheet pile 110. Similarly, flange 112 of the adjacent sheet of curved sheet pile 110 extends across the upper surface 96 of curved sheet pile 110. In this manner, flanges 100, 112 cooperate to interfit adjacent sections of curved sheet pile 110 to one another. Additionally, once in the position shown in FIG. 12, flanges 100, 112 may be secured to the adjacent sections of curved sheet pile, such as by welding.

Figure 14:
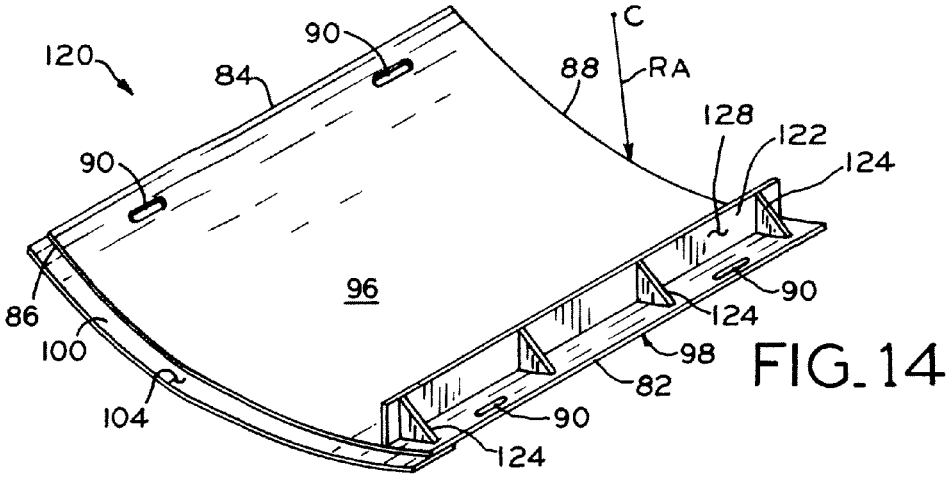
FIG. 14 is a perspective view of a section of curved sheet pile according to another exemplary embodiment.

Referring to FIG. 14, another exemplary embodiment of curved sheet pile 10 is shown as curved sheet pile 120. Curved sheet pile 120 is substantially similar to curved sheet pile 80 and like reference numerals have been used to identify identical or substantially identical parts therebetween. Curved sheet pile 120 includes a projection in the form of radially extending flange 122 extending from upper surface 96 of curved sheet pile 120 toward center C of the radius of curvature RA of curved sheet pile 120. In addition, supports 124 are secured to rear surface 128 of flange 122 and correspondingly secured to upper surface 96 of curved sheet pile 120. Flange 122 allows for curved sheet pile 120 to push and compact any subterranean material 14 that may fall onto curved sheet pile 120 during insertion back into position beneath a conduit to help prevent the loss of subterranean material 14 from beneath the conduit, as described in detail below.

Figure 13:
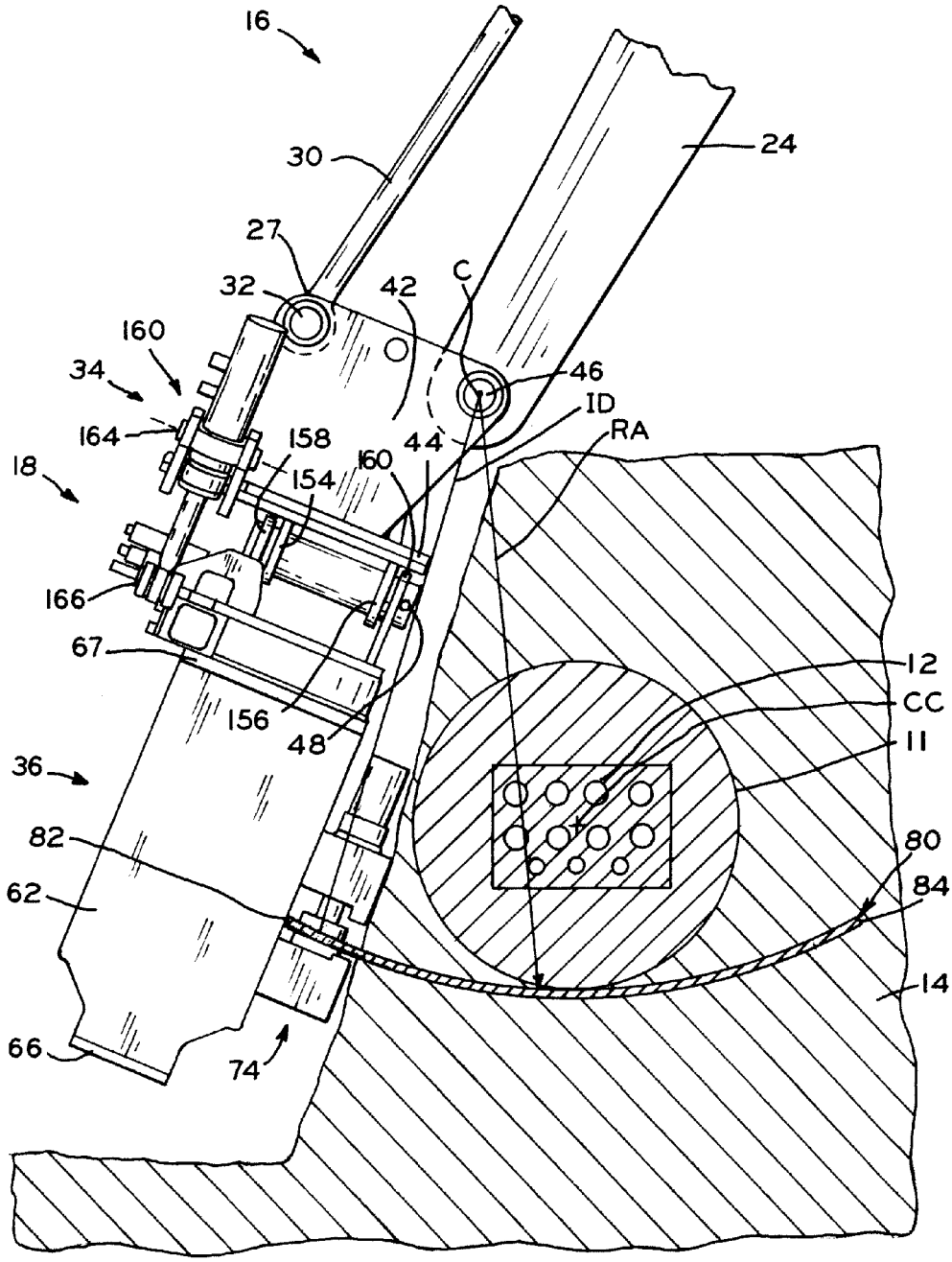
FIG. 13 is a fragmentary, partial cross-sectional view of a section of curved sheet pile being installed beneath a conduit.

As indicated above, pile driver 18 allows for curved sheet pile 10, 80, 110, 120 to be inserted beneath a conduit by pivoting pile driver 18 about insertion axis IA (FIG. 2), without the need to otherwise move or manipulate pile driver 18 and/or excavator 16 in any other manner. Referring to FIG. 13, in order to insert a section of curved sheet pile, such as curved sheet pile 80, clamps 74 are positioned to grasp gripping edge 82 of curved sheet pile 80. While described and depicted with specific reference to curved sheet pile 80, pile driver 18 may be used with any other type of curved sheet pile, such as curved sheet pile 10, 110, 120. By positioning gripping edge 82 of curved sheet pile 80 such that it extends beyond first and second clamp surfaces 76, 78 in a direction toward pile driver 18, one of first and second clamp surfaces 76, 78 may be advanced toward the other of clamp surfaces 76, 78 to capture curved sheet pile 80 therebetween. In one exemplary embodiment, as indicated above, clamps 74 are hydraulically actuated to clamp curved sheet pile 80 between first and second clamp surfaces 76, 78.

Referring to FIG. 13, with curved sheet pile 80 secured by clamps 74, curved sheet pile 80 may be positioned with leading edge 84 of curved sheet pile 80 positioned adjacent to and below conduit 12. Preferably, insertion axis IA, which is defined by pin 46, is also positioned directly vertically above center CC of conduit 12. With curved sheet pile 80 positioned within the excavated opening and before leading edge 84 of curved sheet pile 80 is advanced into the subterranean material, the position of pile driver 18 and/or excavator 16 may be locked, such that movement of pile driver 18 and/or excavator 16 is substantially limited or entirely prevented such that insertion axis IA is spatially fixed. Hydraulic cylinder 30 of excavator 16 may then be actuated to extend hydraulic cylinder 30 and rotate pile driver 18 and, correspondingly, curved sheet pile 80.

Specifically, as hydraulic cylinder 30 is extended, pile driver 18 is rotated about insertion axis IA. Advantageously, by matching a section of curved sheet pile 80 having radius of curvature RA that is substantially identical to insertion distance ID of pile driver 18 and positioning clamps 74 such that the center of the radius of curvature of curved sheet pile 80 lies substantially on insertion axis IA, curved sheet pile may be inserted along an arc having a radius of curvature that is substantially identical to radius of curvature RA of curved sheet pile 80. By positioning clamps 74 such that insertion distance ID is substantially equal to radius of curvature RA of curved sheet pile 10 and center C of the radius of curvature of curved sheet pile 80 lies substantially on insertion axis IA, pile driver 18 may be actuated about insertion axis IA to allow pile driver 18 to position curved sheet pile 10 beneath a conduit without the need for any additional movement of pile driver 18 and/or articulated boom 20 of excavator 16, as described in detail below. Stated another way, with insertion distance ID being substantially identical to radius of curvature RA of curved sheet pile 80, a point that lies substantially on insertion axis IA defines center C of radius of curvature RA of curved sheet pile 80, as shown in FIG. 13. While described herein as having insertion distance ID being substantially identical to radius of curvature RA of curved sheet pile 80, insertion distance ID may be a few percent, e.g., one percent, two percent, or three percent, less than or greater than radius of curvature RA of curved sheet pile 80, while still operating in a similar manner as described in detail herein and also still providing the benefits identified herein.

Advantageously, by utilizing an insertion distance ID that is substantially identical to radius of curvature RA of curve sheet pile 80 and positioning center C of radius of curvature RA on insertion axis IA, pile driver 18 may be actuated to rotate about a single, stationary axis, i.e., insertion axis IA, to insert curved sheet pile 80 into subterranean material 14 and maintain the advancement of curved sheet pile 80 along an arc having the same curvature as curved sheet pile 80. This eliminates the need for the operator of excavator 16 to simultaneously manipulate the position of articulated boom 20 while pile driver 18 is being rotated in order to adjust the position of the insertion axis to facilitate the insertion of curved sheet pile 80 along an arcuate path having the same curvature as curved sheet pile 80. Stated another way, the present invention eliminates the need for the operator of the excavator to manipulate articulated boom 20 and or pile driver 18 to attempt to maintain center C of radius of curvature RA of curved sheet pile 80 at a point that lies substantially on insertion axis IA of pile driver 18.

Figure 15:
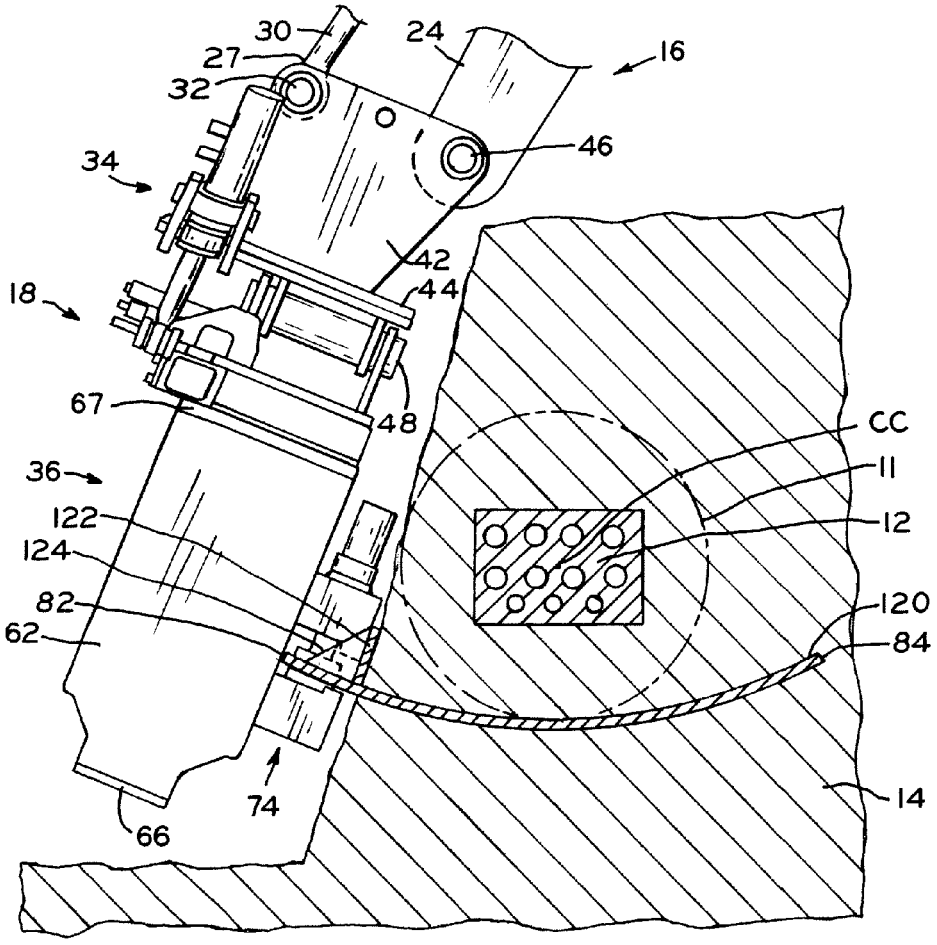
FIG. 15 is a fragmentary, partial cross-sectional view of the section of curved sheet pile of FIG. 14 being installed beneath a conduit.

Referring to FIG. 15, pile driver 18 is shown inserting curved sheet pile 120 into subterranean material 14. As indicated above, during insertion of curved sheet pile 120 into subterranean material 14, any subterranean material, such as soil and/or rocks, that may fall onto upper surface 96 of curved sheet pile 120 may be compacted into subterranean material 14 by flange 122. Specifically, as flange 122 arrives at the position shown in FIG. 15, any subterranean material 14 that may have fallen onto upper surface 96 of curved sheet pile 120 is compacted by flange 122 into subterranean material 14 that is providing support for conduit 12. In this manner, any subterranean material that may come loose from beneath conduit 12 during insertion of curved sheet pile 120 is compacted beneath conduit 12 to maintain the support of conduit 12 provided by subterranean material 14.

Figure 16:
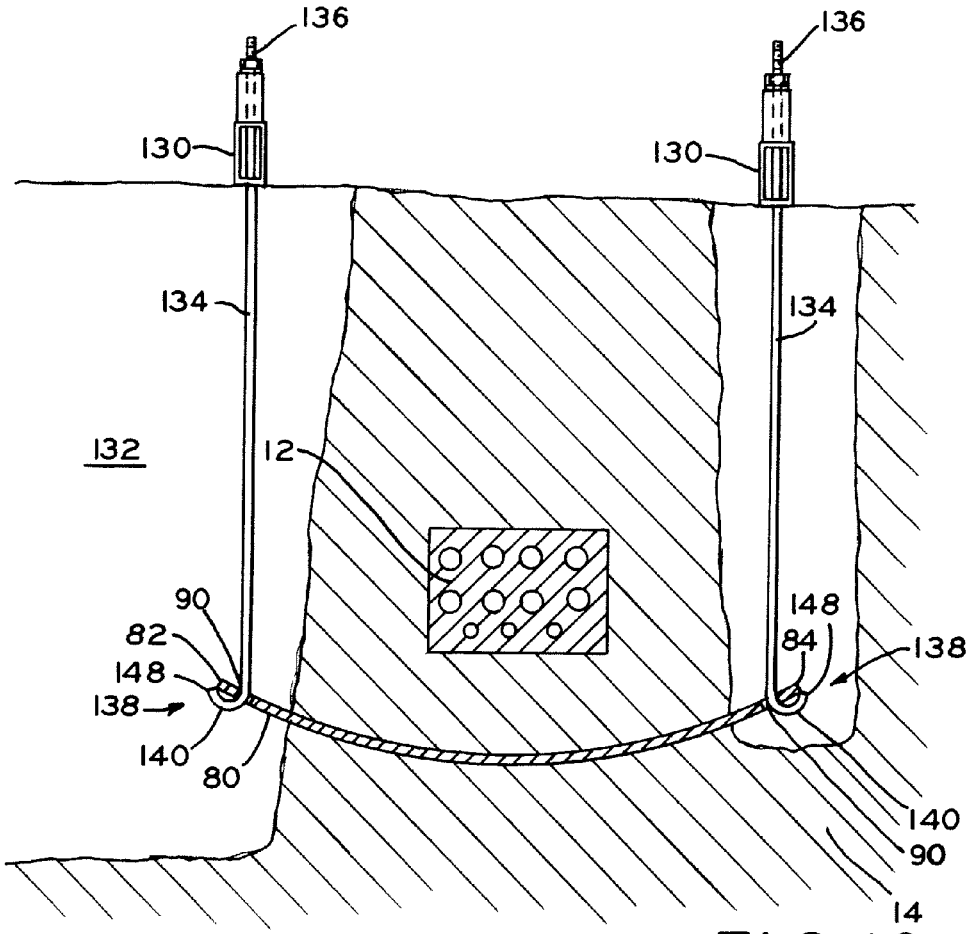
FIG. 16 is a cross-sectional view of a section of curved sheet pile positioned beneath a conduit and secured in position by a support structure.
Figure 17:
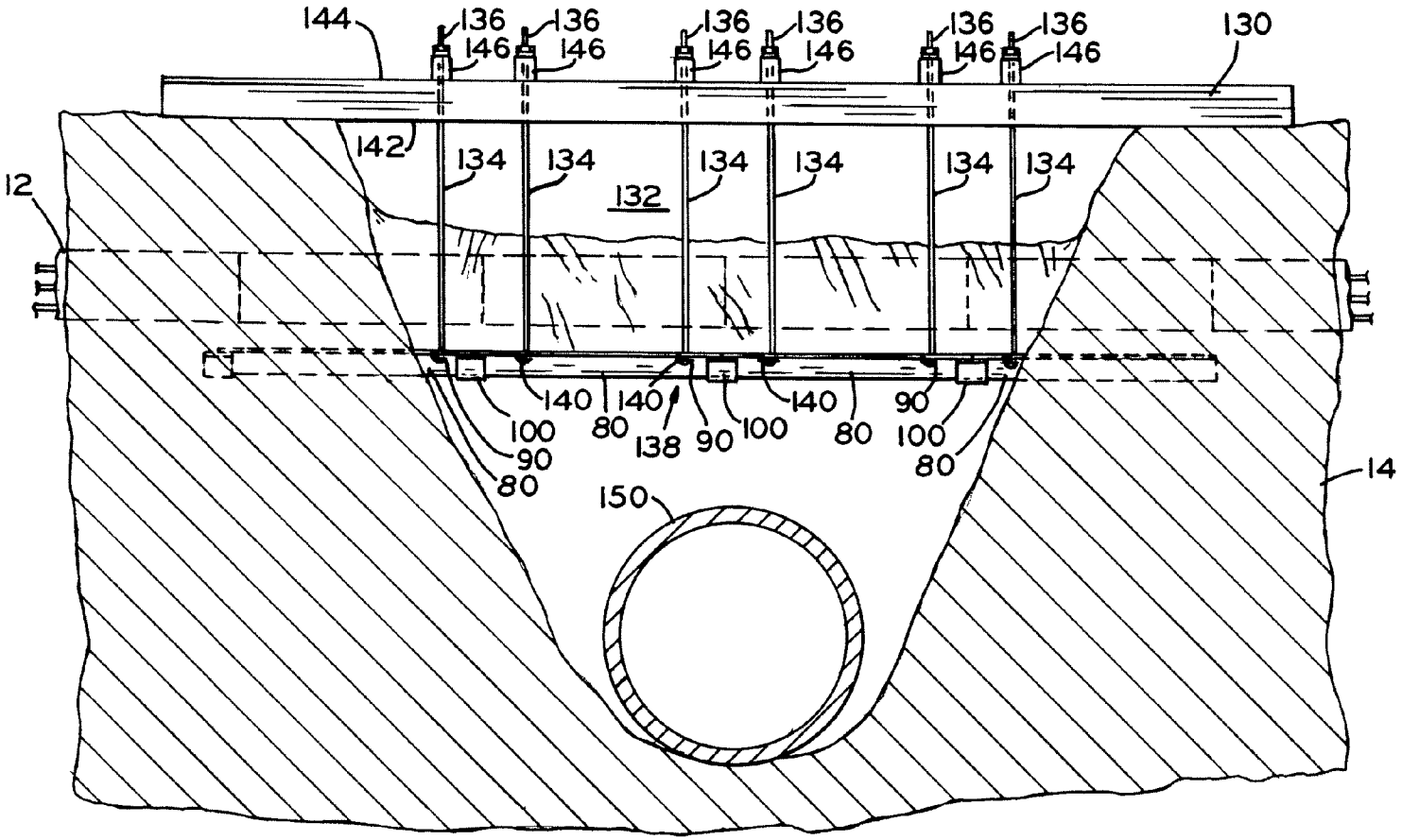
FIG. 17 is a partial cross-sectional view of a plurality of sections of curved sheet pile positioned beneath a conduit and secured in position by the support structure of FIG. 16.

Referring to FIGS. 16 and 17, a support structure for supporting sections of curved sheet pile 10, 80, 110, 120 after sections of curved sheet pile 10, 80, 110, 120 have been inserted within subterranean material 14 is shown. Specifically, beams 130 are positioned to extend across trench 132 formed in subterranean material 14. In this manner, the opposing ends of beams 132 that contact the subterranean material 14 on opposing sides of trench 132 provide a base of support for sections of curved sheet pile 10, 80, 110, 120. Specifically, in order to connect individual sections of curved sheet pile 10, 80, 110, 120 to beams 130, rods 134 are used. Rods 134 have first, threaded ends 136 and opposing connection ends 138. In one exemplary embodiment, connection ends 138 of rods 134 are formed as J-hooks 140. In order to secure rods 134 to sections of curved sheet pile 10, 80, 110, 120, rods 134 are inserted through openings 90 in curved sheet pile 10, 80, 110, 120, by longitudinally aligning J-hooks 140 with planar side walls 94 of openings 90. J-hooks 140 are then advanced through openings 90 and rotated 90 degrees to capture of portion of curved sheet pile 10, 80, 110, 120 on J-hooks 140 and prevent J-hooks 140 from advancing back out of openings 90.

In order to secure rods 134 to beams 130, threaded ends 136 of rods 134 are advanced through openings formed in beams 130. Specifically, threaded ends 136 of rods 134 are advanced through beams 130 from lower, ground contacting surfaces 142 of beams 130 until at least a portion of threaded ends 136 of rods 134 extend from upper surfaces 144 of beams 130. Threaded bolts 146 are then threadingly engaged with threaded ends 136 of rods 134 and advanced therealong. Specifically, bolts 146 are advanced in the direction of upper surfaces 144 of beams 132 until bolts 146 firmly engage upper surfaces 144 of beams 130. For example, bolts 146 may be advanced until ends 148 of J-hooks 144 are in contact with lower surfaces 148 of sections of curved sheet pile 10, 80, 110, 120. Once in this position, curved sheet pile 10, 80, 110, 120 is sufficiently supported by beams 130 and rods 134. This process may be repeated as necessary. Specifically, in one exemplary embodiment, curved sheet pile 10, 80, 100, 120 is secured at each of openings 90 by rods 134 to beams 130.

Referring to FIG. 17, once the individual sections of curved sheet pile 10, 80, 110, 120 are effectively supported in position, an additional portion of trench 132 beneath sections of curved sheet pile 10, 80, 100, 120 may be excavated, to allow for the placement and/or repair of an additional conduit 150 beneath conduit 12. Once conduit 150 is properly installed and/or repaired, beams 130 and rods 134 are removed from the individual sections of curved sheet pile 10, 80, 110, 120 and trench 132 is backfilled with subterranean material.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pile driver and sheet pile combination, comprising:

a pile driver having a clamp and a head portion configured for connection to an articulated boom, said head portion being rotatable relative to the articulated boom about a first pivot element that defines an insertion axis, said clamp having a pair of opposing clamp surfaces adapted to engage a section of sheet pile, said insertion axis being spaced from said opposing clamp surfaces by an insertion distance; and a section of curved sheet pile having a pile radius of curvature, said pile radius of curvature being substantially equal to said insertion distance, wherein, with said section of curved sheet pile secured between said opposing clamp surfaces of said clamp, a point defining a center of said pile radius of curvature lies substantially on said insertion axis.

2. The combination of claim 1, wherein said section of curved sheet pile further comprises a front edge, a rear edge, and opposing side edges extending between said front edge and said rear edge, said front edge, said rear edge, and said opposing side edges cooperating to define a perimeter, said section of curved sheet pile further comprising a first flange extending outwardly from one of said opposing side edges and extending beyond said perimeter.

3. The combination of claim 2, wherein said section of curved sheet pile further comprises an upper surface and a lower surface, said first flange extending from one of said upper surface and said lower surface.

4. The combination of claim 2, wherein said section of curved sheet pile further comprises an upper surface, a lower surface, and a second flange, said first flange extending from said upper surface, and said second flange extending from said lower surface and beyond said perimeter of said section of curved sheet pile.

5. The combination of claim 4, wherein said first flange has a first flange radius of curvature substantially equal to said pile radius of curvature and said second flange has a second flange radius of curvature substantially equal to said pile radius of curvature.

6. The combination of claim 2, wherein said first flange has a flange radius of curvature substantially equal to said pile radius of curvature.

7. A vibratory pile driver system, comprising:

a vibratory pile driver, comprising:

a head portion having a first pivot element configured to connect said head portion to an articulated boom, said first pivot element defining an insertion axis about which said vibratory pile driver is rotatable;

a body secured to said head portion by a second pivot element, said second pivot element defining a body axis of rotation about which said body is rotatable relative to said head portion;

a vibration generator; and a clamp having an upper clamp surface and a lower clamp surface, at least one of said upper clamp surface and said lower clamp surface actuatable relative to the other of said upper clamp surface and said lower clamp surface between an open position configured for receipt of a section of curved sheet pile and a closed position configured to secure a section of curved sheet pile between said upper clamp surface and said lower clamp surface, wherein, with said upper clamp surface and said lower clamp surface in a closed position, said upper clamp surface and said lower clamp surface extend along a plane that is perpendicular to a line extending perpendicularly from said insertion axis to said upper clamp surface and said lower clamp surface.

8. The vibratory pile driver system of claim 7, further comprising:

a section of curved sheet pile having a pile radius of curvature, said pile radius of curvature being substantially equal to an insertion distance, wherein said insertion distance is substantially the distance between said first pivot element and a point between said upper and lower clamp surfaces of said clamp of said vibratory pile driver when said upper and lower clamp surfaces are in a closed position.

9. The vibratory pile driver system of claim 8, wherein, with said section of curved sheet pile secured between said upper clamp surface and said lower clamp surface, a point defining a center of said pile radius of curvature lies substantially on said insertion axis.

10. The vibratory pile driver system of claim 8, wherein said curved sheet pile further comprises an upper surface, a lower surface, and a flange extending outwardly from one of said upper surface and said lower surface, said flange having a radius of curvature that is substantially identical to said pile radius of curvature.

11. The vibratory pile driver system of claim 10, further comprising a plurality of sections of said curved sheet pile, each said flange of each of said plurality of sections of said curved sheet pile configured to interfit with another of said plurality of sections of said curved sheet pile.

12. The vibratory pile driver system of claim 7, wherein said clamp is secured to said vibration generator.

13. A pile driver and sheet pile combination, comprising:

a pile driver having a head portion configured for connection to an articulated boom, said head portion being rotatable relative to the articulated boom about a first pivot element that defines an insertion axis;

said pile driver including a body having an upper portion connected to said head portion, a foot portion and sides extending between the upper and foot portions;

a clamp extending laterally outwardly beyond one of said sides, said clamp having a pair of opposing clamp surfaces moveable between an open position and a closed position, said insertion axis being spaced from said opposing clamp surfaces by an insertion distance measured when said opposing clamp surfaces are in a closed position; and a section of curved sheet pile having a pile radius of curvature, said pile radius of curvature being substantially equal to said insertion distance, wherein, with said section of curved sheet pile secured between said opposing clamp surfaces of said clamp, a point defining a center of said pile radius of curvature lies substantially on said insertion axis.

14. A method of inserting a section of curved sheet pile beneath a conduit buried underground, the method comprising the steps of:

providing a section of curved sheet pile having a pile radius of curvature;

providing a pile driver having a pivot element with a spatially fixed axis and a clamp, said clamp having a pair of opposing clamp surfaces adapted to engage a section of sheet pile;

securing the section of curved sheet pile to the pile driver with the clamp;

positioning the pile driver and curved sheet pile adjacent subterranean material supporting a conduit; and rotating the pile driver about the pivot element fixed axis to advance the curved sheet pile beneath the conduit without otherwise substantially altering the position of the pile driver.

15. The method of claim 14, further comprising the step of connecting the pile driver to an articulated boom at the fixed pivot element, wherein the pile driver is rotatable relative to the articulated boom about the insertion axis defined by the fixed pivot element.

16. The method of claim 15, wherein the step of providing a pile driver further comprises providing a pile driver having an insertion distance measured between the opposing clamp surfaces and the insertion axis, the insertion distance being substantially equal to the radius of curvature of said curved sheet pile.

17. The method of claim 15, wherein the step of securing the section of curved sheet pile to the pile driver further comprising securing the section of curved sheet pile to the pile drive such that a point defining a center of the radius of curvature of the curved sheet pile lies substantially on the insertion axis.

18. The method of claim 14, wherein the pile driver comprises a vibratory pile driver.

* * * * *